US007045978B2

(12) United States Patent
Kulish et al.

(10) Patent No.: US 7,045,978 B2
(45) Date of Patent: May 16, 2006

(54) MULTI-CHANNEL INDUCTION ACCELERATOR

(75) Inventors: Victor V. Kulish, Kylv (UA); Alexandria C. Melnyk, Powel, OH (US); Aleck K. Landgraf, Columbus, OH (US)

(73) Assignee: Viara Research, LLC, Columbus, OH (US)

( * ) Notice: Subject to any disclaimer, the term of this patent is extended or adjusted under 35 U.S.C. 154(b) by 115 days.

(21) Appl. No.: 10/797,380

(22) Filed: Mar. 10, 2004

(65) Prior Publication Data

US 2005/0200321 A1 Sep. 15, 2005

(51) Int. Cl.
*H05H 9/00* (2006.01)

(52) U.S. Cl. ..... 315/505; 315/501; 250/491.1; 250/396 R

(58) Field of Classification Search ..... 315/505, 315/501, 500, 506, 507, 111.61; 250/491.1, 250/396 R See application file for complete search history.

(56) References Cited

U.S. PATENT DOCUMENTS

| | | | | |
|---|---|---|---|---|
| 6,433,494 | B1 * | 8/2002 | Kulish et al. | 315/500 |
| 6,580,084 | B1 * | 6/2003 | Hiramoto et al. | 315/507 |
| 2002/0109472 | A1 * | 8/2002 | Kulish et al. | 315/505 |

* cited by examiner

*Primary Examiner*—Wilson Lee
*Assistant Examiner*—Ephrem Alemu
(74) *Attorney, Agent, or Firm*—Mueller and Smith, LPA

(57) ABSTRACT

A multi-channel induction accelerator (MIAC) comprised of the injector block, the drive source, the output device, and the multi-channel induction acceleration block. The latter is made in the form of an aggregate of one-channel linear induction acceleration blocks (including those which are oriented parallel one to other), each of which is made in the form of a sequence of the linearly connected acceleration sections, each of which, in turn, is made in the form of one or a few magnetic inductors enveloped by a conductive screen. Therein, at least one of the conductive screens is made in such a manner that it envelops at least two acceleration sections, which belong to different one-channel linear induction acceleration blocks. The invention allows to increase electric voltage in acceleration spaces of the acceleration sections without increasing the current strength in the inductors winding, and to increase efficiency of the accelerator.

3 Claims, 6 Drawing Sheets

MULTI-CHANNEL INDUCTION ACCELERATOR

CROSS-REFERENCE TO RELATED APPLICATIONS

STATEMENT REGARDING FEDERALLY SPONSORED RESEARCH

Not applicable.

BACKGROUND OF THE INVENTION

The invention concerns acceleration engineering, and is especially addressed to induction accelerators. It has application as a commercial-type compact powerful accelerator of charged particles for the formation of relativistic beams of charged particles and for systems of many parallel multi-component beams.

There is known an induction accelerator, which can be used as a device for the formation of singular electronic relativistic beams. Redinato L. "The advanced test accelerator (ATA), a 50-MeV, 10-kA Inductional Linac." *IEEE Trans.,* NS-30, No 4, pp. 2970–2973, 1983. This device also is called a one-channel linear induction accelerator (OILINAC). The OILINAC is composed of the injector block, the drive source, output system, and a one-channel linear induction acceleration block. Its peculiarity is that the one-channel linear induction acceleration block is made in the form of a sequence of linearly connected acceleration sections. Each of the acceleration sections is made in the form of magnetic inductors, which are enveloped by a conductive screen. The acceleration of the beam is achieved by the effect of longitudinal vortex high-frequency (tens MHz) electric field, which is generated within the acceleration space of the section. The acceleration space is made in the form of a special break in the conductive screen. Thus, the conductive screen shields the outside of the acceleration section (with respect to its inner part) from the penetration of the vortex electric field. This occurs everywhere within the acceleration section, apart from the special break in the conductive screen, which plays a role of the acceleration interval (accelerative space). The acceleration channel in the OILINAC has a linear form. This is the main cause why these systems are called "linear".

The large linear (longitudinal) dimensions, limited functional potentialities, and a limited range of the current strength of the beam are the basic shortcomings of the OILINAC.

The large dimensions of the OILINAC (e.g. 60–70 m length for the ATA class) are related with its moderate rate of linear acceleration. The typical energy rates of acceleration for the OILINAC are ~0.7–1.5 MeV/m. For example, in the above-mentioned design of OILINAC [Redinato L. "The advanced test accelerator (ATA), a 50-MeV, 10-kA Inductional Linac."*IEEE Trans.,* NS-30, No 4, pp 2970–2973, 1983] the averaged value of the acceleration rate is ~0.75 MeV/m. This means that in the case of the 50-MeV system its total length is ~70 m. This causes strong complications in overall infrastructure and its accommodation and service (because it needs special accommodation, radiation-protection systems and service, etc.). Consequently, commercial application of OILINAC as a basic construction element for various types of commercial devices becomes economically unsuitable because of their excessive price.

The other shortcoming of the OILINAC is that only one charged particle beam is accelerated on all stages of the acceleration process, i.e., OILINAC is one-channel and one-beam, at the same time. However, a series of practical applications require the formation of charged-particle beams with a multi-component structure, for example, the electron beams for the two-beam superheterodyne free-electron lasers, complex (electron-ion or ion-ion) beams for some technology systems, etc. A direct use of the OILINAC in such situations is impossible, since, as it was mentioned before, they are designed for the formation of exclusively one-energy and one-component relativistic beams of charged particles. This means that the OILINAC possesses limited functional possibilities with respect to potential fields of application.

It is well known that the limitation for the range of beam current strength in the OILINAC exists from the "down" as well as the "upper" sides. The limitation from the "down" side is connected with lower level of its efficiency in the case when the beam current magnitudes are smaller than some critical value. For instance, such critical beam current equals ~1 kA for most of the modern electronic OILINACs. This happens because the main power losses in OILINAC are related with the losses in the re-magnetization of the magnetic inductor cores. These losses depend mainly on the core material and they do not depend practically on the beam current strength. On the other hand, the useful power is the power which the beam obtains during the acceleration process. This power, in contrast to the first case, depends on the beam current. As it is widely known, the particle efficiency of the acceleration process can be determined as a ratio of the useful power to the total (i.e., sum of the losses and useful) power. This means that the main reason for the efficiency increase is the increase of the beam current. As experience showed, the power of losses became approximately equal to the useful power in the case when (critical) current beam is ~1 kA. Just owing to this, the modern OILINACs with high level of efficiency are usually characterized by the electron beam current $\geqq 1$ kA. However, many practical applications require beams with a lower level of current and, at the same time, high efficiency. The mentioned shortcoming reduces essentially the range of the possible practical OILINAC applications.

The limitation mentioned from the "upper" side is related with an increasing role of the beam instability at an increase of the beam density. Consequently, the formation and the acceleration of electron long tens-kA beams becomes technologically a very complicated problem, and the formation of a few hundreds-ka beams becomes practically impossible.

There is also known an inductional accelerator, which can work as a device for the formation of relativistic beams of charged particles and which is named the multi-channel induction accelerator (MIAC). Two design versions of the MIAC are known including the multi-channel induction linear accelerator (MILINAC) [V. V. Kulish, A. C. Melnyk. Multi-Channel Linear Induction Accelerator, U.S. Pat. No. 6,653,640 B2; issued Nov. 25, 2003.], and the Multi-Channel Induction Undulative Accelerator (MIUNAC) [V. V. Kulish, P. B. Kosel, A. C. Melnyk, N. Kolcio Induction Undulative EH-Accelerator, U.S. Pat. No. 6,433,494 B1, issued Aug. 13, 2001]. The latter is also called the EH-accelerator [V. V. Kulish. Hierarchical Methods. Vol. II. Undulative electromagnetic systems. Kiuwer Academic Publishers, Boston/Dordrecht/London, 2002]. MIAC consists of the injector block, the drive source, the output device, and the multi-channel induction acceleration block. Here the multi-channel acceleration block is made in the form of an aggregate (including that placed parallel with one to other) of one-channel linear induction acceleration blocks. Similarly to the OILINAC, each one-channel linear induction acceleration block is made in the form of a sequence of the linearly connected acceleration sections. In turn, each of the acceleration sections is made in the form of one or few magnetic inductors enveloped by an individual conductive screen.

The MILINAC and MIUNAC design versions distinguish themselves by the form of the partial output devices of the one-channel linear (i.e., partial) induction acceleration blocks. So, the partial output systems in the MILINAC are made in the form of outlets for the accelerated beams. The partial output systems in MILINAC can have also a form of devices that brings together different accelerated beams. It can bring together the beams of the same kind of charged particles (e.g. different-energy beams of electrons or other charged particles) as well as the beams of different kind of particles (electron and ions or positive and negative ions, etc.). This means that particle trajectories of each partial accelerating beam in MILINAC always have a line-like form.

In contrast to the MILINAC at least a part of the partial output systems is made in the form of magnetic turning systems. Each of the turning systems connects the output of one of the one-channel linear induction acceleration blocks with an input of other similar block. Only those inputs, which are connected with injectors, and those outputs, which are destined for coming out the accelerated partial beams, are exceptions from this rule. Thus, each of the acceleration channels in the MIUNAC represents by itself a sequence of linear parts (the partial channels within the one-channel accelerative blocks) and turns for the angle 180° (the part of the channel within a turning system). This gives eventually an undulative-like form of the accelerating charged particle beam. That is why the systems of this class are called the undulative.

Thus, the community of the design variants of the MILINAC and the MIUNAC is characterized in that both contain multi-channel induction acceleration blocks, which are made in the form of an aggregate of one-channel linear induction acceleration blocks (including those oriented parallel one to other). The differences concern the form of the partial output systems of the output block.

Both design versions are not always competitors and each of them has its optimal areas of applications. For instance, the most promising field of the MILINAC utilization is the systems of electron beams with relatively low energy (a few MeV's) and super-high currents (tens-hundreds kA's). Or, it can be used for combined electron-ion or ion-ion high current beams, etc. The main merit of the MIUNAC is its obviously expressed compactness. For example, total length of the OILINAC of the ATA type can be reduced from ~70 m to ~13 m in the case, when the MIUNAC design with five turns of the accelerating electron beam is used.

Thus, the multi-channel induction accelerator (MIAC) solves part of the problems that are characteristic for the OILINAC. However, some problems were not solved satisfactorily. One of them, which we consider the main problem, is relatively low MIAC efficiency, especially in the case of the moderate currents of the accelerated beams.

BRIEF SUMMARY OF THE INVENTION

This device (the MIAC) is most similar to the invention proposed with respect to the technological essence and result achieved. This device is accepted as a prototype. The aim of the invention is to construct the commercial-type multi-channel induction accelerator (MIAC), which is characterized by increased efficiency.

The aim is attained with a multi-channel induction accelerator (MIAC), comprising an injector block, a drive source, output systems, and a multi-channel induction acceleration block, which is made in the form of an aggregate of one-channel linear induction acceleration blocks (including those which are placed parallel one to other), each of which is made in the form of a sequence of the linearly connected acceleration sections, each of which, in turn, is made in the form of one or a few magnetic inductors enveloped by conductive screens in which at least one of the conductive screens is made in such manner that it envelops, at the same time, at least two acceleration sections, which belong to different one-channel linear induction acceleration blocks.

Two different design versions of the MIAC are disclosed. The first one is characterized in that the multi-channel induction acceleration block is accomplished in accordance with the design scheme of the acceleration block of the multi-channel induction linear accelerator (MILINAC).

In the second case the multi-channel induction acceleration block is made in accordance with the design scheme of the acceleration block of the multi-channel induction undulative accelerator (MIUNAC).

Building of the multi-channel induction accelerator of the charged particles, totally with all the essential characteristics, including above described different structural variants of the multi-channel induction acceleration block, is advantageous. Namely, when the electrical voltage, which the magnetic inductors generate in the acceleration space of an acceleration section, turns out to be, simultaneously, applied partially to, at least, the accelerative space of one more neighboring acceleration sections. In turn, the electrical voltage that the magnetic inductors generate in the acceleration space of this neighboring acceleration section, is also applied partially to the acceleration space of the first section, and so on. This allows an increase in the electrical voltage in acceleration spaces of the acceleration sections without increasing the current strength in the inductor windings. This achieves the same practical magnitudes of the voltage for essentially lower magnitudes of the current strength in the windings of inductors. Or, in other words, the same voltage can be obtained with lower energy losses for the magnetic cores re-magnetizing. The latter leads automatically to increasing efficiency of the accelerator.

DETAILED DESCRIPTION OF THE INVENTION

Figure 1:
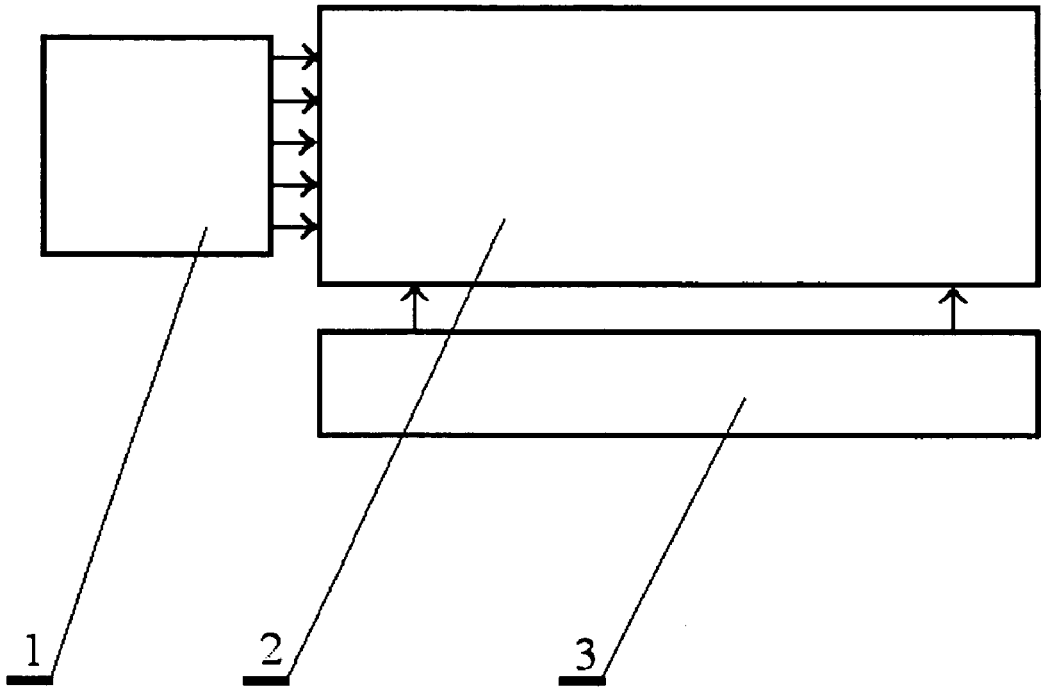
FIG. 1 is a schematic representative of the structural electric scheme of the multi-channel induction accelerator (MIAC)

The multi-channel induction accelerator (MIAC, see FIG. 1) comprises an injector block 1, which is attached to a multi-channel induction acceleration block 2. A drive source 3 is attached, at the same time, to the block 1. The output systems here are included conditionally into the multi-channel induction acceleration block 1. The injector block is made in the form of separate or an aggregate of separate electron and ion injectors.

Figure 2:
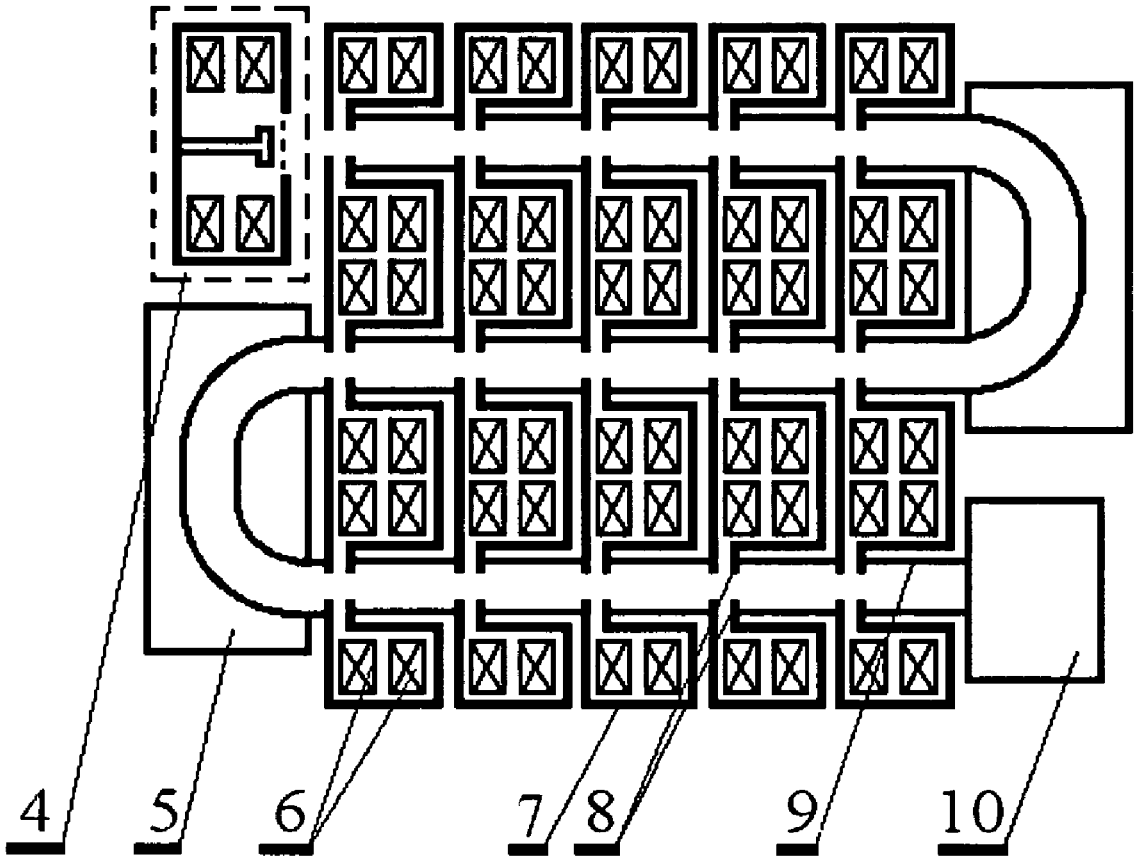
FIG. 2 schematically shows the structure of the MIAC constructed on the basis of MIUNAC.

The design example of the MIAC, constructed on the basis of the MIUNAC, is shown in FIG. 2. There 4 is the injector of the block 1, 5 are the turning systems for the charged particle beam, 6 are the magnetic inductors of the acceleration sections, 7 are the conductive screens, 8 are the accelerative spaces in the undulative acceleration channel 9, 10 is the output system. The multi-channel induction acceleration block 2 is made in the form of three parallel placed one-channel induction acceleration blocks, each of which, in turn, is constructed from five acceleration sections. The injector 4 in this partial case is attached to the input of the first (upper) one-channel induction acceleration block. The acceleration sections are formed of groups of inductors 6. The conductive screens 7 envelop each such a group. In accordance with the invention, the screens 7 are made in such manner that each of them envelops three parallel placed groups of inductors 6, at the same time. Therein, output of the first one-channel induction acceleration block is connected to the input of the second block, and its output, in turn, is connected to the input of the third block by the turning systems 5. The output system 10 (consisting in this case of one output device) is connected to the output of the third one-channel induction acceleration block.

The so-called planar scheme of arrangement is used in the design version, an example of which is presented in FIG. 2. There all one-channel induction acceleration blocks are placed in the same plane. The peculiarity of this scheme is that it is asymmetric with respect to the design of the screens 7. Namely, the second (i.e., middle) one-channel induction acceleration block is connected to two analogous outside blocks, at the same time. In contrast, each of the outside blocks (i.e., the first and the third, respectively) are connected to one neighboring (middle) block only. The volumetric schemes of arrangement are proposed also, including the schemes where each one-channel induction acceleration block is connected to two (or more) neighboring analogous blocks. Such volumetric schemes provide higher magnitudes of the accelerator efficiency than the planar schemes.

It is proposed to construct the multi-beam MIACs of two and more described one-beam designs. Therein common conductive screens can connect the acceleration sections of different one-beam designs.

Figure 3:
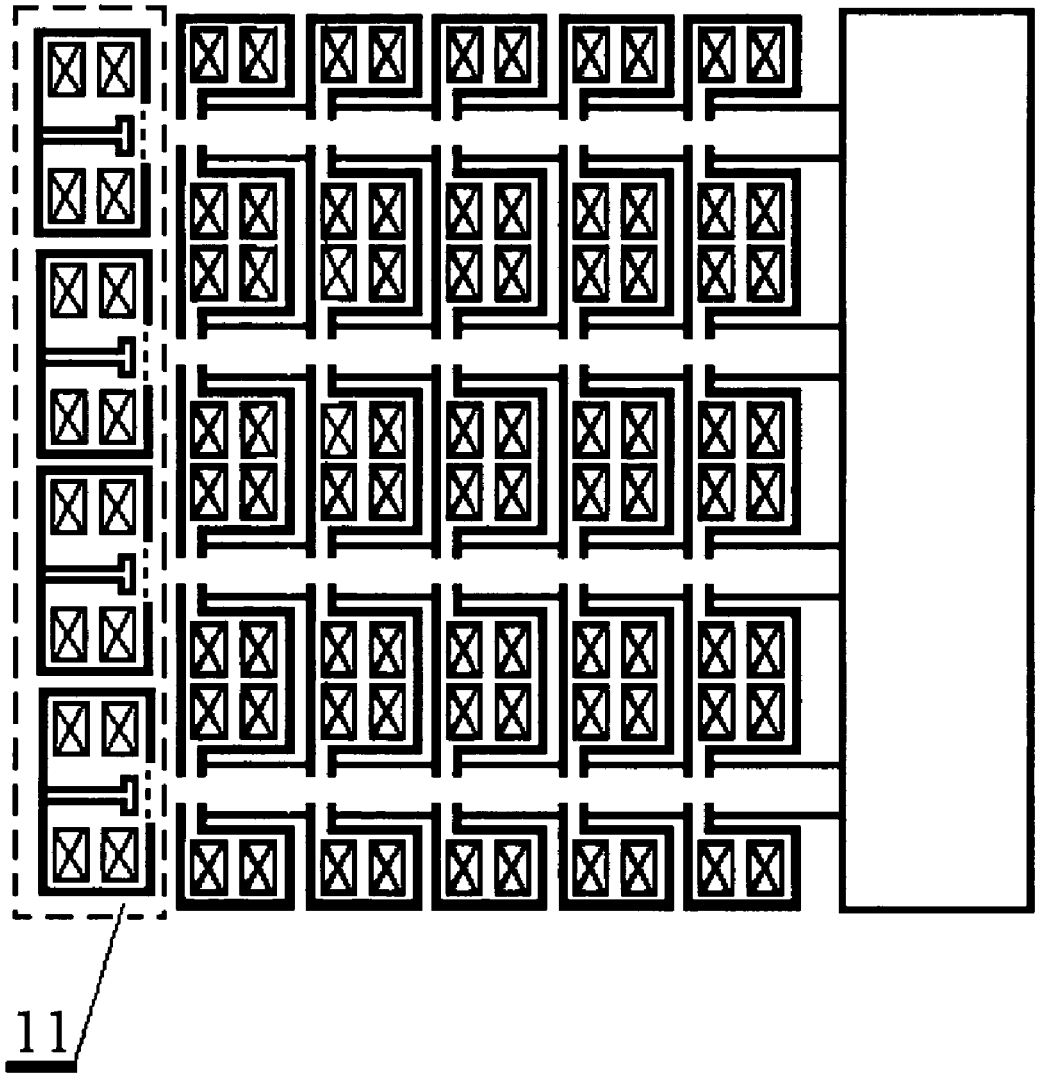
FIG. 3 illustrates the similar structure of the MIAC constructed on the basis of MILINAC.

The design example of MIAC, constructed on the basis of MILINAC, is shown in FIG. 3. It differs from the above-discussed undulative version, which is represented in FIG. 2, in that the injector block 11 is made in the form of an aggregate of four separate injectors like 4. Therein, two different design versions of accomplishing the injector block 4 are possible. In the first case one pair of the injectors only (the first and the third, for instance) can be made as the electron injectors, whereas the second pair (the second and the fourth injectors) are accomplished as ion injectors, which are working synchronously with the electron injectors. In the second case both pairs of injectors are made as the electron (or ion) injectors. A specific feature of this design version is that both pairs work in the so-called trigger mode. It is the mode, in which when one of the pairs is working then the other of the pairs is "resting", and vice versa.

Analogously with the present (undulative) design variant the volumetric design versions can be realized in this case, too. Moreover, this version is most promising in the case, when there are two or more channels.

The proposed multi-channel induction accelerator (MIAC) works in the following manner. The injector block 1 forms beams of charged particles, which are directed into the linear part of the first working acceleration channels 9. The beams are accelerated while passing the channels. In the case of MIUNAC the beam is accelerated in the first one-channel linear induction acceleration block, directed into the turning system 5, and then it is accelerated in the second one-channel linear induction acceleration block and so on. In the case of MILINAC, each beam is accelerated in the first one-channel linear induction acceleration blocks then all of them are directed into the output systems 10.

A characteristic feature of MIACs, which work in the mentioned above trigger mode, is that that different pairs of injectors work periodically. In the case of the version represented in FIG. 3 this means the following. When the first pair of injectors work, then only the one-channel induction acceleration blocks that are connected with it are used for beams acceleration immediately. Other two one-channel induction acceleration blocks at that time are in the so-called idle mode. That can explain this that the electric field within the "idle accelerative channels" is broken for the chosen kind of charged particles (while analogous field at that time is the accelerative in the channels of the first pair). Thus, the second pair of channels for the considered phase of the working process is used for increasing the voltage only in the accelerative space of the first pair. Or, in other words, it is used for acceleration indirectly. The first pair of the one-channel linear induction acceleration blocks begins to work in the idle mode first after the expiration of the accelerative phase. Therein, the second pair becomes to work as in the accelerative mode, and so on. The specific feature of the MIAC, which works in the trigger mode, is that the formed output beam system is characterized by two times higher magnitude of the off-on-time ratio than separate injectors have.

Figure 5:
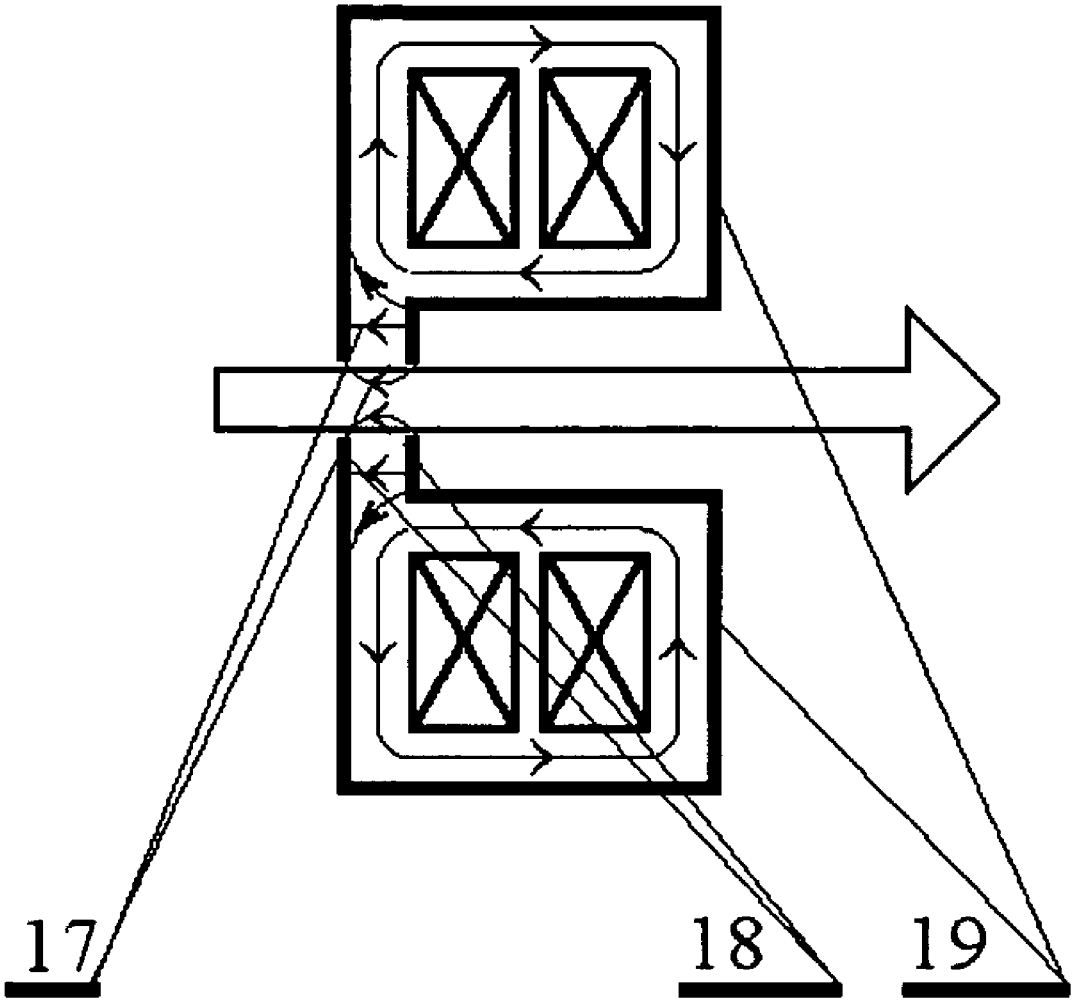
FIG. 5 illustrates a scheme similar to FIG. 4, but having an acceleration section with a separate conductive screen.
Figure 6:
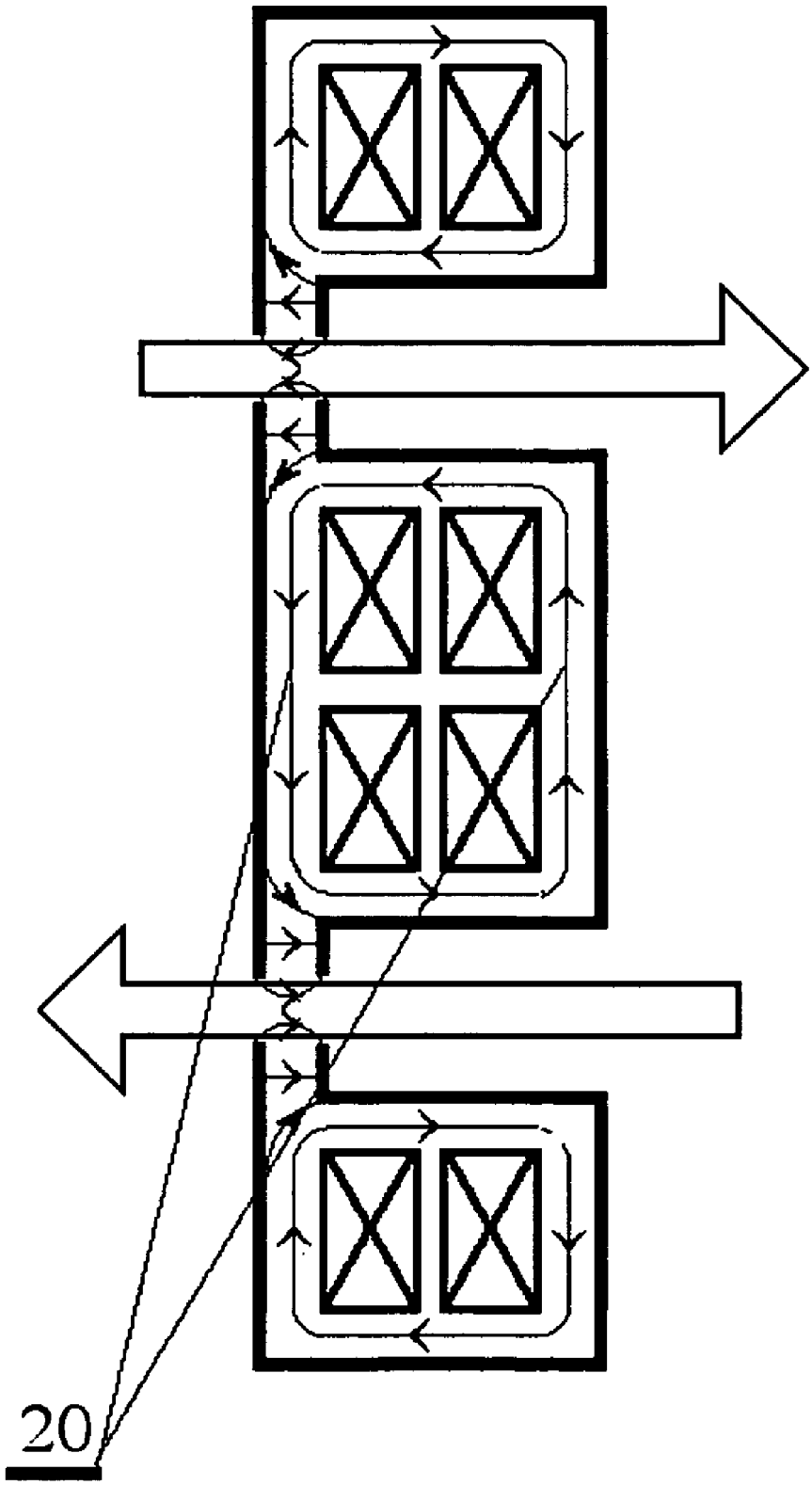
FIG. 6 illustrates a similar scheme where two neighboring acceleration sections have a common conductive screen.

The characteristic feature of the design proposed is that the conductive screens 7 are common for a few parallel acceleration sections, which, in turn, belong to different one-channel linear induction acceleration blocks. Owing to this each of the magnetic inductors 6, as it is mentioned above, takes part in forming voltage in each accelerative space of the sections, which are enveloped by common screen. As a result, the voltage, which is acting on beam particles in the accelerative space, forms as a sum of voltages, which are generated by all inductors of this and all neighboring inductors (i.e., the inductors enveloped by a common screen). This means that the voltage in this case turns out to be higher than in the case of a prototype, where, as it is mentioned before, a "personal" separate conductive screen envelops each acceleration section. Physical peculiarities of this physical process are illustrated in details in FIGS. 4–6.

Figure 4:
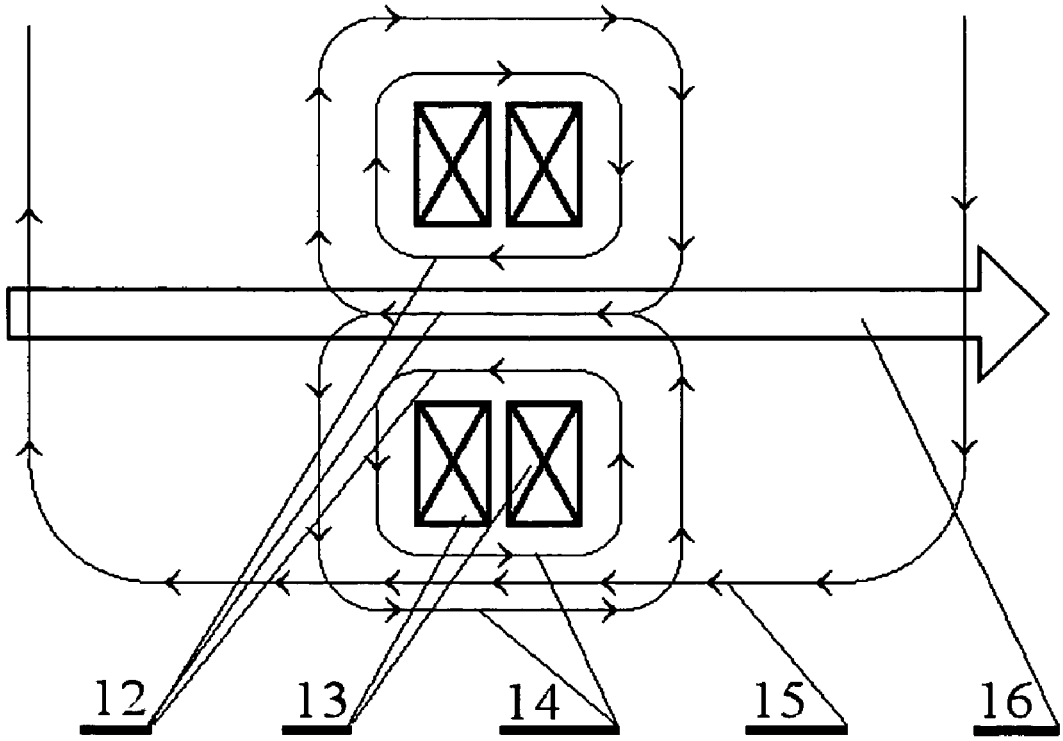
FIG. 4 illustrates the scheme of the formation of the strength lines of the vortex electric field, which is generated by the magnetic inductors in the acceleration section without a conductive screen.

The scheme, which illustrates the process of forming strength lines of the electric field generated by inductors of an acceleration section without the conductive screen, is shown in FIG. 4. There 12 are the inner parts of the strength lines, 13 are the magnetic inductors, 14 are the "proper" parts of the outside strength lines, 15 are the "strange" parts of the outside strength lines, and 16 is the charged particle beam (electron, for instance). Accordingly with the relevant Maxwell's equations, the magnetic flux, which circulates within magnetic cores of the inductors 13, generates the vortex electric field. This field is represented in FIG. 4 as a sum of three electric fields, which are pictured by the strength lines 12, 14 and 15 respectively. Including, the inner electric field 12 generates within the inner parts of the inductors 13. Correspondingly, the outside part of the electric field is generated outside with respect to the inductors 13. Therein two types of the outside field can be distinguished. They are the "proper" 14 and the "strange" ones, respectively. The "proper" field 14 is the field, which is generated by a part (the lower in the case of FIG. 4) of inductor in nearest outside space. In contrast, the "strange" field 15 is the field, which is generated in the same place by the remote part (the upper in the case of FIG. 4) of inductor. Thus, it is readily seen, that the resulting outside electric field, in the discussed case of section without conductive screen, always can be determined as a sum of the "proper" and "strange" fields. Both these fields, as it is obviously seen in FIG. 4, are directed oppositely with respect of one to other. This means that the phenomenon of reciprocal compensation of the "proper" and "strange" fields is characteristic for the acceleration sections without the screen (that are characteristic for the prototype). It should be mentioned, however, that the complete compensation of both fields occurs in the area located far from the inductors 13. The particular compensation only has place in the nearest surrounding volume. This circumstance is used in the prototypes for increasing the energy acceleration rate.

The energy, which the beam 16 obtains under action of the vortex electric field in the discussed case (see FIG. 4), can be determined as a work A, which the inner electric field 12 fulfils under the beam particles:

$$A=Fl=qEl,$$

where F=qE is the electric Lorenz's force, q is the particle charge, l is the length where the beam acceleration occurs. This length l coincides approximately with the length of the straight part of strength lines of the inner electric field. Thus, only ~¼ part of the total length of the electric strength line is used in this case for acceleration. The remaining ¾ traditionally (in the OILINACs, for example) is not used for this purpose.

Placing inductors in the conductive screen (see FIG. 5) does not change the conclusion formulated. Similarly to the previous case (see FIG. 4), only the inner part of the electric field is used there for beam acceleration. This is the part of total electric field 17, which is localized within the accelerative space 18.

However, some essential differences are in the case concerning the physics of the outside-field formation. The point is in the introduction of the screen 19 that leads to screening of the outside part of the electric field. As a result the "strange" part of the outside field 15 does not generate because it turns out to be screened by the screen 19. This means that the effect of the reciprocal compensation of the "proper" and "strange" parts of the outside field, discussed above, does not take place in the system represented in FIG. 5. However, it should be mentioned that this circumstance does not have any useful application in the traditional induction accelerators, including the prototypes (where it is also foreseen the use of the acceleration sections with screens like in FIG. 5). In contrast to the tradition, it plays an important role in the design proposed.

Thus, the main idea of the invention is the effective use for acceleration of charged particle beams by the inner as well as the outside electric fields simultaneously. The illustration of this idea is given in FIG. 6. There is shown a scheme of the electric strength lines for a case when two neighboring acceleration section have a common conductive screen. It is readily seen that a part of the strength lines like 20 take place in forming the voltage in both the accelerative spaces simultaneously. Therein, the resulting voltage is formed as a sum of the "proper" inner and the "neighboring" outside field. This means that magnitudes of the voltage in each accelerative space are higher than in the case of prototype. Or, in other words, the efficiency of the proposed variant is higher because at the same energy losses for magnetic cores remagnetizing the useful energy (i.e., the energy, which is spend for charged particle acceleration) is higher.

Let us point out that only two versions of the accelerative sections are foreseen in the prototype. The first one is the version without conductive screens for each section. Some increase of the accelerator efficiency takes place in this case, but it is comparatively small because of the realization of the above-described effect of the reciprocal compensation of the "proper" and the "strange" outside electric fields (see corresponding comments to FIG. 4). The use of "personal" conductive screen for each separate acceleration section is foreseen in the case of second variant (see FIG. 5). An increase of the accelerator efficiency does not take place because all the outside parts of the electric field within different sections turn out to be screened by the screens.

The invention allows using the accelerator as a commercial-type compact accelerator of charged particles, including singular and multiple parallel relativistic beams of charged particles.

What is claimed is:

1. A multi-channel induction accelerator, comprising:

an injector block;

a drive source;

output systems; and a multi-channel induction acceleration block, which is made in the form of an aggregate of one-channel linear induction acceleration blocks (including those that are placed parallel with one to other), each of which is made in the form of a sequence of linearly connected acceleration sections, each of which, in turn, is made in the form of one or more magnetic inductors, each linearly connected acceleration section being enveloped by a separate conductive screen and at least one of the separate conductive screens being made in such a manner that it envelops at least two acceleration sections which belong to different one-channel linear induction acceleration blocks.

2. The multi-channel induction accelerator of claim 1, in which:

the multi-channel induction acceleration block is composed in accordance with the design scheme of the acceleration block of the multi-channel induction linear accelerator.

3. The multi-channel induction accelerator of claim 1, in which:

the multi-channel induction acceleration block is configured in accordance with the design scheme of the acceleration block of the multi-channel induction undulation accelerator.

* * * * *